US005543767A

United States Patent [19]

Elenbaas

[11] Patent Number: 5,543,767

[45] Date of Patent: Aug. 6, 1996

[54] ELECTRICAL SWITCH

[76] Inventor: George H. Elenbaas, 25526 N. Shore Dr., Elkhart, Ind. 46514

[21] Appl. No.: 382,961

[22] Filed: Feb. 2, 1995

[51] Int. Cl.[6] ..... H01H 9/00

[52] U.S. Cl. ..... 335/205; 335/207

[58] Field of Search ..... 335/205–7

[56] References Cited

U.S. PATENT DOCUMENTS

| | | | |
|---|---|---|---|
| 2,475,728 | 7/1949 | Smith . | |
| 2,513,754 | 7/1950 | Sidwar . | |
| 2,716,168 | 8/1955 | Shonka . | |
| 3,596,021 | 7/1971 | Saul . | |
| 3,617,664 | 11/1971 | Tetrault . | |
| 3,678,763 | 7/1972 | Brooks . | |
| 3,710,369 | 1/1973 | Takahashi . | |
| 3,943,485 | 3/1976 | Waldman . | |
| 3,978,301 | 8/1976 | Bitko . | |
| 4,099,040 | 7/1978 | Bitko . | |
| 4,135,067 | 1/1979 | Bitko . | |
| 4,381,504 | 4/1983 | Bitko . | |
| 4,438,430 | 3/1984 | Young et al. . | |
| 4,536,727 | 8/1985 | Romano . | |
| 4,910,634 | 3/1990 | Pipkorn . | |
| 5,209,343 | 5/1993 | Romano et al. . | |
| 5,227,250 | 7/1993 | Bobal et al. . | |
| 5,325,078 | 6/1994 | Carothers | 335/205 |
| 5,332,992 | 7/1994 | Woods . | |

*Primary Examiner*—Lincoln Donovan
*Attorney, Agent, or Firm*—George Pappas

[57] ABSTRACT

An electrical switch functioning as a tilt, proximity or relay switch includes an elongate cylindrical housing with a first open end and a second closed end. A flexible spring extends longitudinally in the housing and is supported away from the housing by a seal at the open end. The housing and spring are electrically conductive and an electrically-conductive spherical ball is located within the housing for selective rolling engagement with the spring and housing. The switch functions as a single pole single throw type switch. A second spring can be located at the closed second end of the housing and supported similar to the first spring. By locating the spherical ball between the two springs, a single pole double throw switch is formed.

26 Claims, 4 Drawing Sheets

ELECTRICAL SWITCH

TECHNICAL FIELD

The present invention relates to the technical field of mechanically actuated electrical switches. More specifically, the present invention relates to an electrical switch capable of functioning as a tilt switch, a proximity switch, or a relay and, further, wherein the switch can function as a single pole single throw, or single pole double throw switch.

BACKGROUND OF THE INVENTION

Many different tilt, proximity and relay switches currently exist and are in use. Most tilt switches incorporate mercury within a housing for making contact between the housing and an electrode thereby causing actuation in response to tilting. Unfortunately, mercury is a toxic substance which, more recently, has become undesirable due to environmental concerns. Additionally, a mercury type switch is generally expensive to manufacture in view of the critical seal required to contain the mercury. Proximity and relay switches are also quite often expensive to manufacture in view of their component parts and labor costs.

Accordingly, a need exists for tilt, proximity and relay switches that are environmentally safe, reliable, and which are also generally inexpensive to manufacture.

SUMMARY OF THE INVENTION

It is the principal object of the present invention to overcome the above-discussed disadvantages associated with prior electrical switches.

The present invention overcomes the disadvantages associated with prior electrical switches by providing a single structure of a switch which, with minor modification or adaptation, can function as a tilt switch, proximity switch, or a relay. The switch structure includes an elongate preferably cylindrically-shaped housing having a first open end and a second closed end. A flexible, preferably compression type spring extends longitudinally in the housing toward but short of the closed end of the housing. The spring is supported in position away from the housing for preventing electrical contact therebetween with a seal, preferably a glass or plastic seal, located at the open end of the housing. Both the housing and the spring are electrically-conductive and a spherical electrically-conductive ball is located in the housing between the spring and the housing closed end.

The ball is selectively free to roll and move within the housing and to selectively come in contact with both the spring and the housing inner surface for creating an electrical path from the housing through the ball and to the spring. A portion of the spring extends through the seal or an electrode member extends through the seal and is electrically connected to the spring within the housing. Accordingly, the spring or electrode and the housing become the electrical contact points of the switch.

The structure of the switch can function as a tilt switch by merely tilting the longitudinal housing at an angle with respect to the horizontal and selectively causing the ball to roll in and out of contact with the spring and housing. By making the housing and spring of non-magnetic materials and the ball of magnetic material, the switch structure can function as a proximity or a relay switch. A proximity switch is provided by, for example, providing a permanent magnet which is adapted for selective placement adjacent the housing. Alternatively, an electromagnet can be placed adjacent the housing and selectively energized for moving the ball in response to the magnetic field. By placing the housing at an angle, with either the closed end or the open end facing generally vertically upwardly, the ball is gravitationally pulled toward or away from the spring thereby providing either a normally closed or a normally open tilt proximity or relay switch.

In another embodiment, rather than a closed end, a second spring is provided at the housing second end and extends into the housing toward the first spring. The ball is located in the housing between the two springs thereby creating a single pole double throw type switch structure with points of contact on the housing and at each of the two springs. This structure has no intermediate off position unless the ball is magnetically or gravitationally retained inbetween and away from the two springs. By "bending" the housing middle section or placing the housing portion extending around the first spring at an angle with respect to the housing portion extending around the second spring, a depression and a peak are formed in the longitudinally central area of the housing. By locating the housing first and second ends to extend generally vertically upwardly, the ball is gravitationally drawn to the depression between the two springs whereat an intermediate off position is provided. The ball can then be caused to come in contact with either of the first or second springs in the housing by tilting or by magnetic fields. Alternatively, by locating the housing so that the first and second ends extend generally vertically downwardly, a peak is created at the central area whereat the ball is prevented from stopping. The ball is always gravitationally pulled toward either one of the first or second springs. Here, a momentary tilt action or momentary magnetic force will change the state of switch contact points from between the first and second springs.

For enhancement of electrical contact, the ball, spring and/or inner surface of the housing can be wetted by mercury or otherwise plated. Additionally, the housing can be square in cross section for creating at least two points of contact between the ball and the housing. Additionally, the housing can be filled with an arc-quenching gas such as argon or hydrogen, or a vacuum can be provided within the housing thereby increasing the life of the switch.

In one form thereof, the present invention is directed to an electrical switch including an elongate electrically conductive housing having an open first end and a closed second end. A flexible electrically-conductive spring extends longitudinally in the housing toward but short of the housing closed end and the spring is supported at the housing first end away from the housing and for preventing electrical contact between the spring and housing. A spherical electrically-conductive ball is provided in the housing between the spring and the housing closed end. The ball is selectively rolling in the housing and selectively comes in contact with both the spring and the housing for creating an electrical path from the housing through the ball and to the spring.

In one form thereof, the present invention is directed to an electrical switch comprising an elongate electrically-conductive housing having a first end and a second end. A first flexible electrically-conductive spring extends longitudinally in the housing through the first end and a second flexible electrically-conductive spring extends longitudinally in the housing from the housing second end. Both first and second springs are supported at each of the housing first and second ends. The springs are supported away from the housing for preventing electrical contact between the springs and the housing. A spherical electrically-conductive ball is provided in the housing between the first and second springs and is selectively rolling in the housing in contact with either of the first spring and the housing or the second spring and the housing thereby creating an electrical path from the housing through the ball and to either of the first or second springs.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Figure 5:
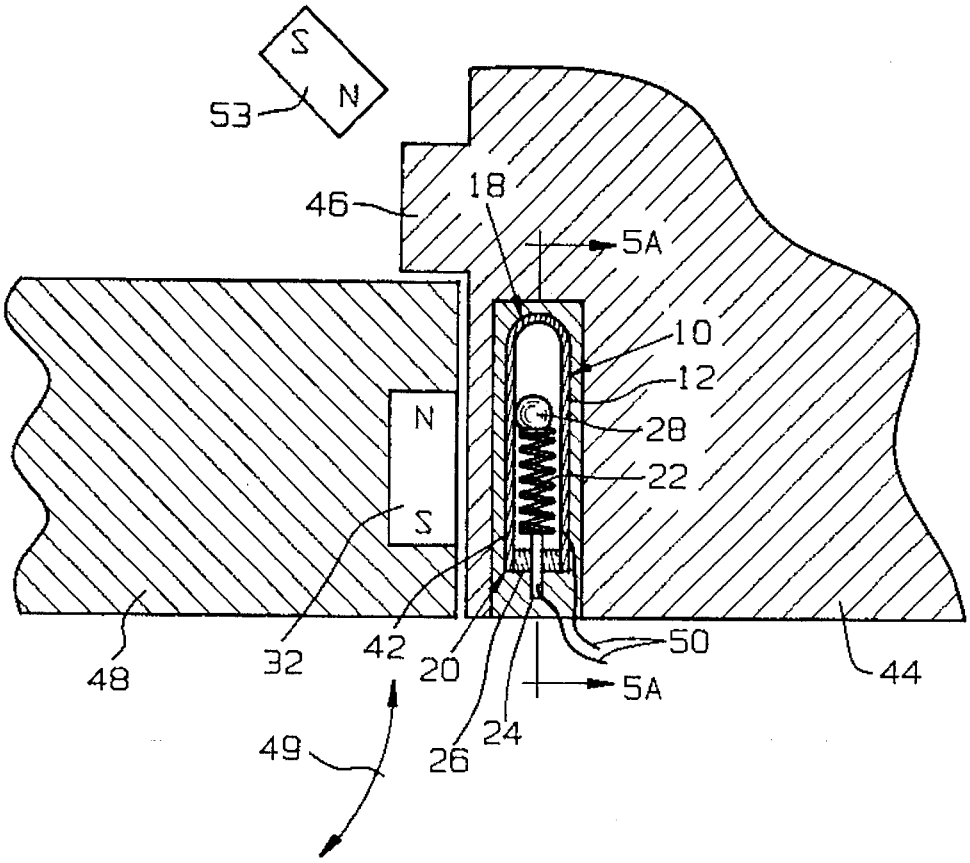
FIG. 5 is a cross sectional side elevational view of the switch of FIG. 1 shown mounted in a door jam and functioning as a proximity switch with a permanent magnet.

FIG. *5a* is a cross sectional view of the switch shown in FIG. 5 taken along line *5a—5a;*

Figure 1:
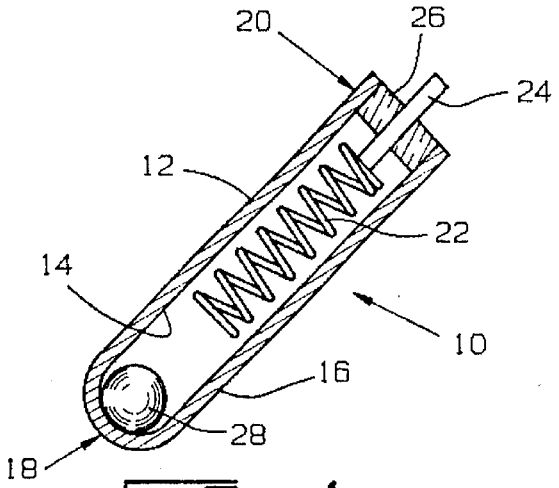
FIG. 1 is a cross section side elevational view of an electrical switch according to the present invention.
Figure 3:
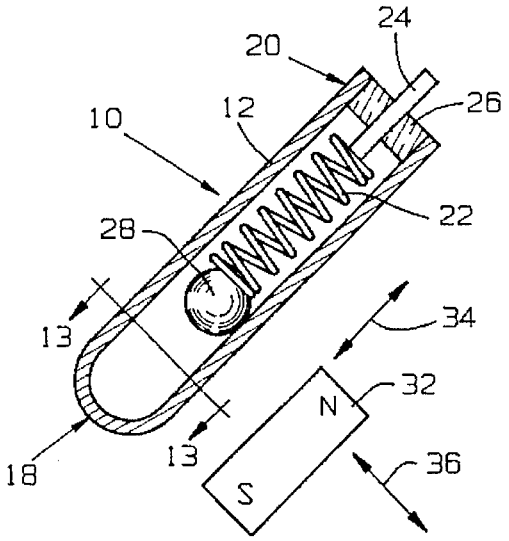
FIG. 3 is a cross sectional side elevational view of the switch of FIG. 1 shown functioning as a proximity switch in conjunction with a permanent magnet.
Figure 6:
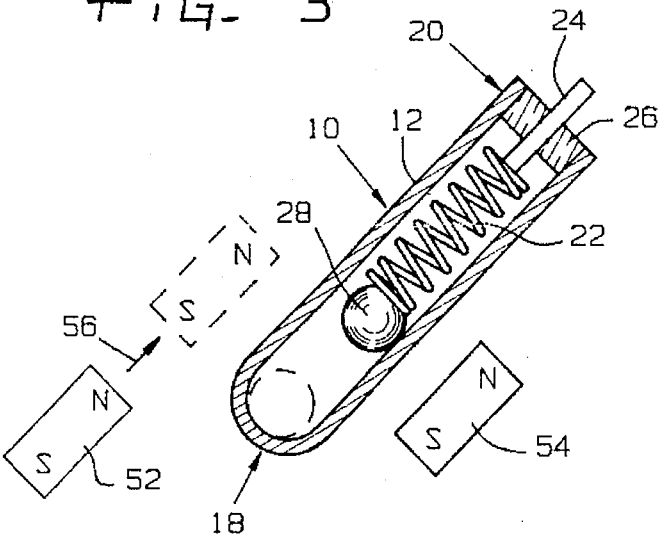
Figure 11:
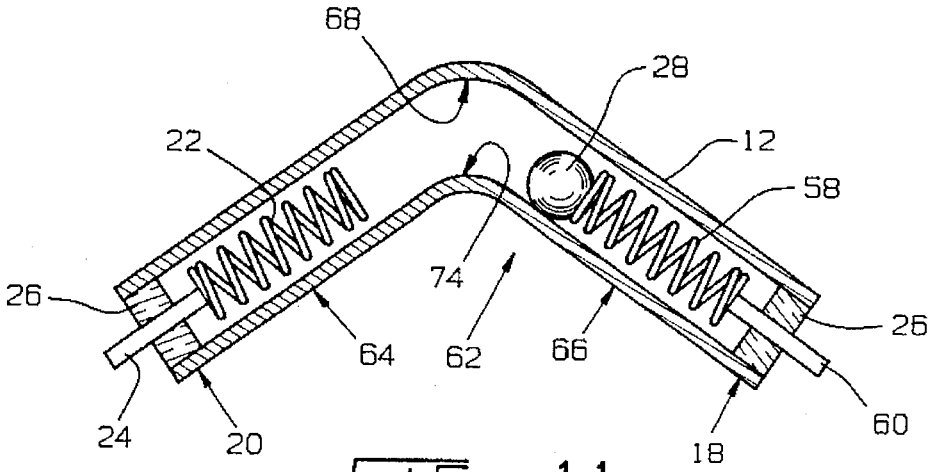
Figure 7:
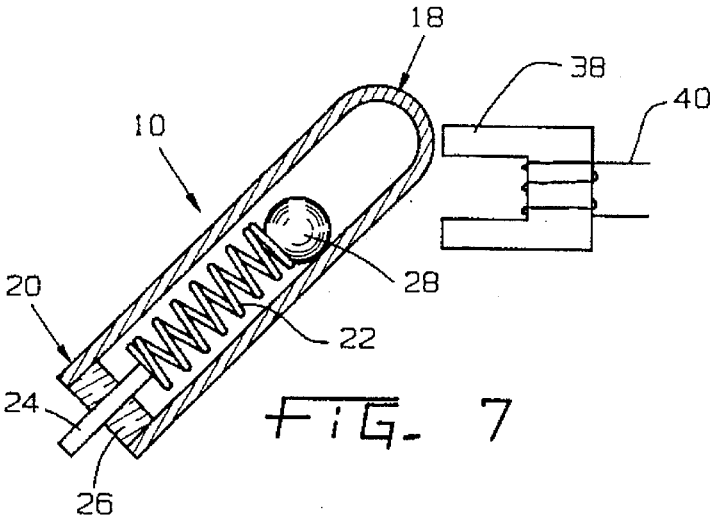
Figure 13:
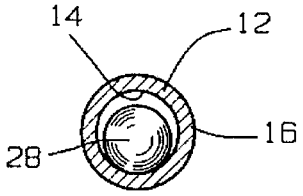
Figure 8:
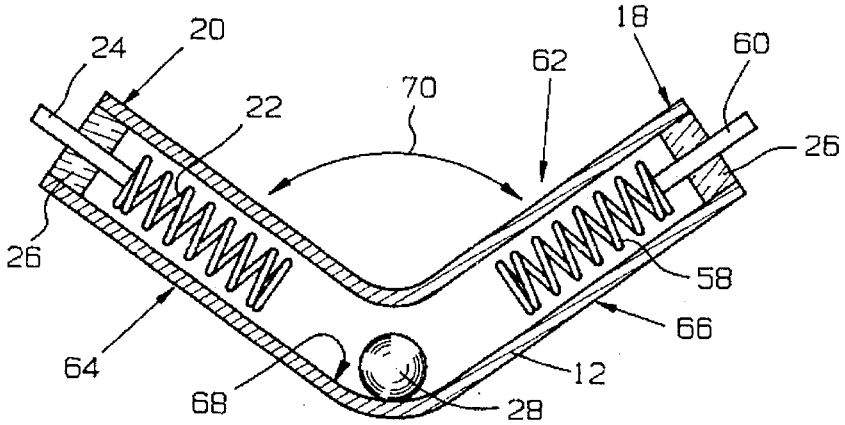
Figure 14:
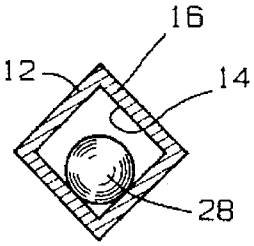
Figure 9:
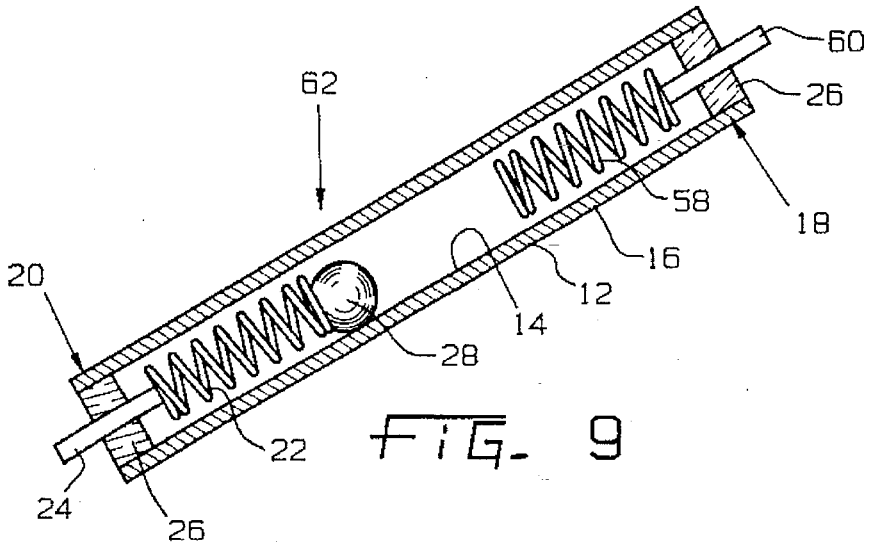
Figure 10:
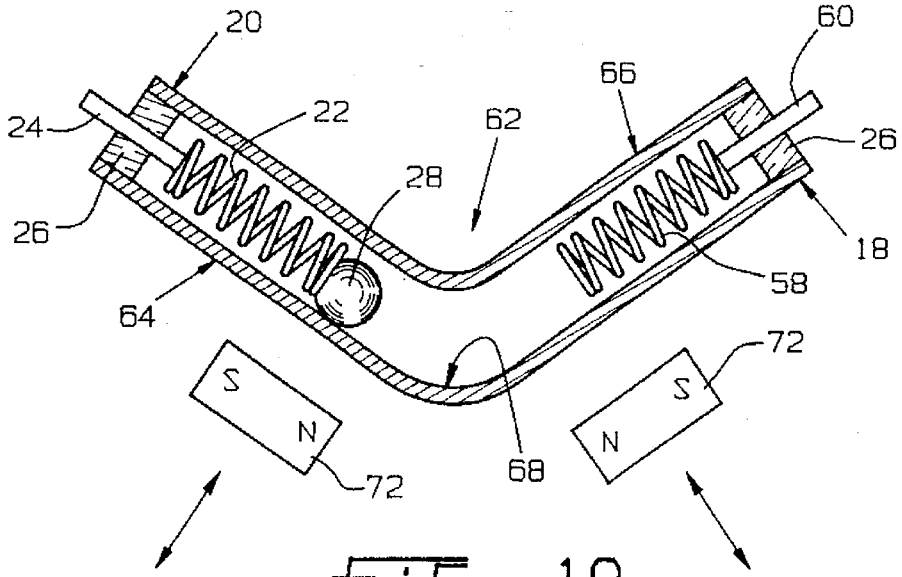
Figure 15:
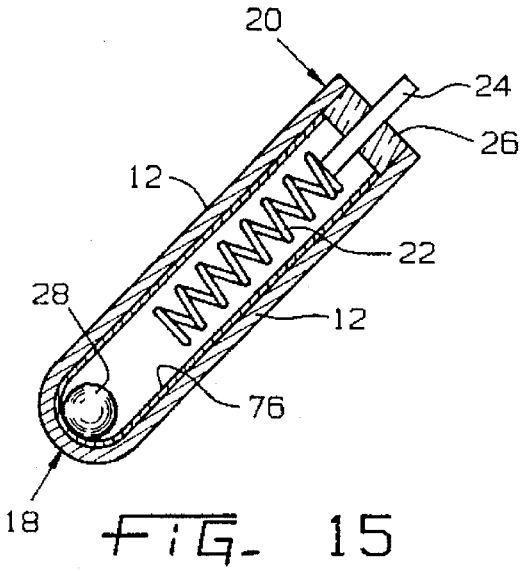
Figure 12:
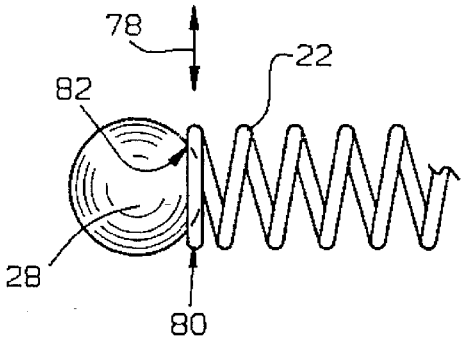

FIG. 6 is a cross sectional side elevational view of the switch of FIG. 1 incorporating a permanent magnet for creating a normally closed switch and a second permanent magnet for functioning as a proximity switch;

FIG. 7 shows the switch of FIG. 1 except with a magnetic ball and non-magnetic housing and spring and with the closed end vertically upwardly above the first end and making the switch gravitationally normally closed and incorporating an electromagnet for functioning as a relay;

FIG. 8 is a cross sectional side elevational view of a second embodiment according to the present invention and showing a single pole, double throw switch with an intermediate off position;

FIG. 9 a cross sectional side elevational view of another single pole, double throw switch according to the present invention without an intermediate off position;

FIG. 10 shows the switch of FIG. 8 except with a magnetic ball and non-magnetic housing and spring and functioning as a proximity switch with permanent magnets placed adjacent thereto;

FIG. 11 shows the switch of FIG. 8 with the housing ends thereof extending generally downwardly and functioning as a single pole double throw switch without an intermediate position;

FIG. 12 is an exploded view of the ball and spring in contact with one another;

FIG. 13 is a cross sectional view of the switch shown in FIG. 3 taken along line 13—13;

FIG. 14 is a cross sectional view similar to FIG. 13 but with a square housing; and, FIG. 15 is a cross sectional side elevational view of the switch of FIG. 1 and incorporating a wetting agent on the housing inside surface.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Referring initially to FIG. 1, an electrical switch according to the present invention is generally indicated by the numeral 10. Electrical switch 10 includes a housing 12 having an inside surface 14 and an outside surface 16. Housing 12 is generally elongate and preferably is cylindrically-shaped as shown in FIG. 13. Housing 12 includes a closed or second end 18 and an open or first end 20. As shown in FIG. 1, housing 12 was formed such as by progressive dies and, thus, closed end 18 is integrally formed. Housing 12 could also be made by using cylindrical or square stock cut to length and closing end 18 in known and customary ways. By way of example, as shown in FIG. 14, housing 12 is square or rectangular in cross section.

Housing 12 is made of an electrically-conductive material such as ferrous steel or, in the event that actuation is to be by magnetic flux, housing 12 is made of an electrically-conductive non-magnetic material such as copper, brass, aluminum, or nonmagnetic stainless steel, etc.

An electrically-conductive spring 22 is provided and extends longitudinally in housing 12. Preferably spring 22 is located coaxially within housing 12. An electrically conductive electrode rod 24 is attached to spring 22 and extends through and is supported by the glass to metal or plastic to metal seal 26. Rod 24 is preferably located coaxial to housing 12 and acts to both support spring 22 as shown and to conduct electrical current from spring 22 through non-conductive glass or plastic seal 26 and to the outside of housing 12. It is noted that electrode rod 24 as used herein is also intended to include an integral extending portion of spring 22 formed as shown rather than a separate rod affixed to spring 22 by solder brazing, welding or other means. Additionally, seal 26 can be of other materials such as plastic, rubber, cork, etc., having sufficient strength for supporting rod 24 and spring 22 as shown away from housing 12 and having sufficient electrical resistance to prevent short circuiting between rod 24 and housing 12.

Spring 22 is preferably of the compression type and, in the event that the switch is actuated by a magnetic flux, it is made of an electrically-conductive non-magnetic material such as copper, brass, aluminum, non-magnetic stainless steel, etc. Spring 22 extends toward but short of closed end 22 leaving a generally open area whereat a spherical electrically-conductive ball 28 is located. Ball 28 is freely movable and rolling within this open area. Ball 28 is made of electrically-conductive materials such as brass, copper, stainless steel, ferrous metals, etc. However, in the event that switch 10 is to be actuated by a magnetic flux, ball 28 is made of an electrically-conductive material which is also magnetic such as ferrous steel.

It is noted that electrical contact to switch 10 from other circuits or components is made in a known and customary manner with housing 12 functioning as one node and rod 24 functioning as the other. The connections from electrical wires thereto can be by solder, welding, friction engagement, etc.

Figure 2:
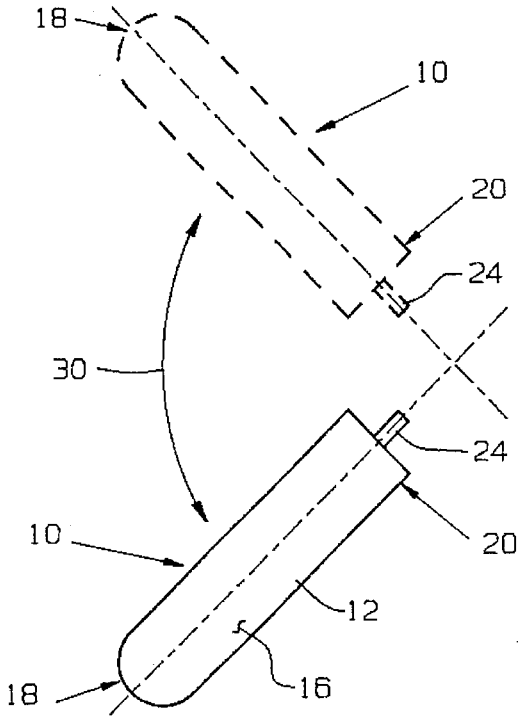
FIG. 2 is a diagrammatic depiction of the switch of FIG. 1 shown in use as a tilt switch.

In operation, switch 10 can function as a tilt switch. More specifically, as shown in FIG. 2, when switch 10 is in the position shown in solid lines, ball 28 is gravitationally pulled toward closed end 18 as shown in FIG. 1. However, when tilted as indicated by arrow 30 to the position shown in dashed lines with closed end 18 located vertically above open end 20, ball 28 is gravitationally pulled toward open end 20 similar to what is shown in FIG. 7. In that position, ball 28 is in contact with both spring 22 and the inner surface 14 of housing 12 thereby providing a closed electrical circuit between housing 12, ball 28, spring 22 and electrode rod 24. As can be appreciated, tilt switch 10, as described, is a single pole single throw switch functioning as a tilt switch. Additionally, it can be normally open or closed depending on whether housing 12 is tilted at an angle to retain ball 28 away from or touching spring 22.

In FIG. 3, switch 10 is shown functioning as a proximity switch actuated by a permanent magnet 32. Here, housing 12 and spring 22 are made of electrically-conductive non-magnetic materials whereas ball 28 is made of an electrically-conductive and magnetic material. The switch is placed with closed second end 18 below open first end 20 thereby gravitationally making this switch normally open. By movement of permanent magnet 32 with respect to switch 10 in the direction of arrows 34 parallel with the longitudinal length of housing 12 or arrows 36 perpendicular to the longitudinal length of housing 12, magnetic ball 28 is selectively drawn toward or away from spring 22 thereby causing switch 10 to function as a proximity switch.

Figure 4:
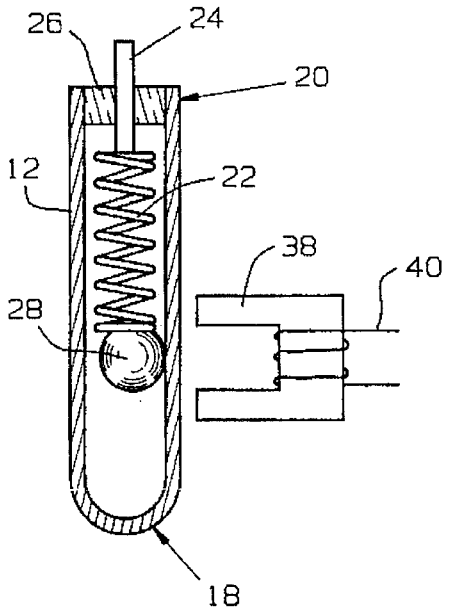
FIG. 4 is a cross sectional side elevation view of the switch of FIG. 1 with an electrical magnet adjacent thereto for functioning as a relay.

Referring now to FIG. 4, switch 10 is shown functioning as normally open electric relay. Here, closed second end 18 is located below open first end 20 thus gravitationally normally retaining ball 28 at closed end 18 and away from spring 22. An electromagnet 38 is provided adjacent housing 12 and electric wires 40 are wrapped around electromagnet 38 and are provided with electric current in a known and customary manner for selectively creating a magnetic flux. Similar to FIG. 3, here housing 12 and spring 22 are made of electrically-conductive non-magnetic materials whereas ball 28 is made of an electrically-conductive and magnetic material. Electromagnet 38 is also located longitudinally with respect to housing 12 so that, when energized, ball 28 is drawn vertically upwardly as shown and in contact with spring 22 and housing 12 and completing the single pole, single throw relay circuit.

Figure 5A:
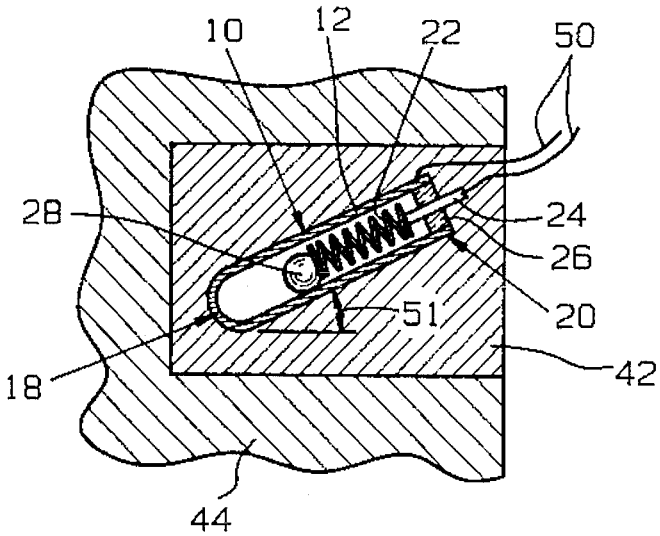

In FIG. 5, switch 10 is shown in use as a proximity switch in a security system. Switch 10 is mounted in a block or plug 42 which is, in turn, placed in for example a door jamb 44. It should be understood that switch 10 and block 42 could just as easily be mounted in a window jam or in other ways as may be needed. Here, a door 48 is shown and swinging in a known and customary manner as evidenced by arrows 49. Door 48 is adapted to abut against stop member 46 of jamb 44. A permanent magnet 32 is mounted in the door at the edge thereof in a manner whereby the flux thereof pulls ball 28 up and in contact with spring 22 in housing 12 whenever door 48 is in its closed position as shown. As also shown in FIG. 5*a*, switch 10 is mounted in jamb 44 in a normally open position and in the event that door 48 is pivoted away from jamb 44 such as by opening, ball 28 will fall toward closed end 18 and thereby opening the security system circuit to which the switch is connected via diagrammatically shown wires 50.

The use of switch 10 as shown in FIG. 5 in a security system circuit is advantageous because switch 10 cannot easily be bypassed by intruders. More specifically, an intruder seeking to bypass the security circuity would normally, for example, place a magnet 53 on the outside of the door and/or jam 44 as diagrammatically shown. With other security system switches such as reed switches or other contact switches, magnet 50 quite often retains the reed or contact switch in a closed position thereby allowing the intruder to open the door without a break in the security system circuit wires 50. With switch 10 mounted as shown, however, the placement of a magnet 53 anywhere along the outside of jam 44 would draw ball 28 downwardly and away from magnet 32 and opening the security system circuit and thereby causing an alarm.

It is noted that block 42 is diagrammatically shown and is used primarily for properly locating switch 10 with closed end 18 being lower than open end 20. Preferably, when placed in jam 44, switch 10 is located about 15 degrees from the horizontal as depicted by arrows 51. Block 42 is contemplated as having an outer shape that would be most convenient for mounting in jams and other building materials and can, for example, be round shaped. In this fashion, the jam can be drilled for creating a bore and a round plug containing switch 10 inserted therein.

In FIG. 6, switch 10 is shown with closed end 18 located below open end 20 and functioning as a proximity switch selectively actuated by a permanent magnet 52. A biasing permanent magnet 54 is also provided adjacent housing 12. Here, housing 12 and spring 22 are made of electrically-conductive non-magnetic materials whereas ball 28 is made of electrically-conductive and magnetic materials. Although closed end 18 is located below open end 20 and ball 28 is gravitationally pulled downwardly, biasing magnet 54 draws ball 28 upwardly and in contact with spring 22 and housing 12. Thus, in FIG. 6, switch 10 is normally closed. For actuation of switch 10, magnet 52 is placed proximate or adjacent housing 12 as shown, for example, by arrow 56. When permanent magnet 52 is placed in the position shown by dashed lines, the flux thereof along with the gravitational force acting on ball 28 draws ball 28 downwardly toward closed end 18 as shown by the dashed line ball and away from spring 22. Accordingly, here switch 10 is opened by movement of magnet 52 adjacent or proximate to housing 12.

Referring now to FIG. 7, switch 10 is shown functioning as a relay similar to FIG. 4 but with closed end 18 located above open end 20 and thereby placing switch 10 in a normally closed position. In this embodiment, energizing electromagnet 38 by providing electric current through wires 40 draws ball 28 upwardly against gravitational forces and toward closed end 18 thereby opening the switch circuit.

In FIGS. 8–11, a second embodiment is shown wherein housing 12 is somewhat longitudinally lengthened and, in addition to a first spring 22 extending through the housing first end 20, a second spring 58 is provided at the second end 18. Similar to first spring 22, spring 58 is supported longitudinally within housing 12 by a glass or plastic or other similar seal 26 and a conductive electrode 60. Accordingly, this switch which is generally designated by the numeral 62 is a single pole, double throw switch with the common pole being the housing 12, the first pole being rod 24 and a second pole being rod 60. Similar to switch 10, single pole double throw switch 62 can function as a tilt switch, a proximity switch or a relay in numerous different ways.

In its simplest form, switch 62 as shown in FIG. 9 includes a longitudinally generally straight housing 12 with first end 20 located below second end 18. Ball 28 is gravitationally pulled toward spring 22 and makes contact therewith and with housing 12. In this position, switch 62 does not incorporate an intermediate position but, rather, housing 12 is normally connected with or is closed to electrode 24. Actuation of this switch for causing ball 28 to move in contact with spring 58 can be caused by tilting and placing second end 18 below first end 26, by proximity means such as a permanent magnet adapted for movement adjacent housing 12 or by an electromagnet placed adjacent housing 12 etc.

In FIGS. 8, 10 and 11, the housing portion 64 extending around spring 22 is located at an angle with respect to the housing portion 66 extending around spring 58. Preferably, housing 12 in this embodiment is merely caused to be bent as shown for forming the angle between portions 64 and 66. By placing first end 20 and second end 18 in the position where both extend generally vertically upwardly as in FIGS. 8 and 10, a depression 68 is formed therebetween and between portions 64 and 66. Accordingly, when switch 62 is located as shown in FIG. 8, ball 28 is gravitationally pulled down to depression 68 and away from both of springs 22 and 58. This creates an intermediate "off" position on the single pole double throw switch. In FIG. 8, switch 62 is shown in use as a tilt switch adapted for movement as indicated by arrows 70. Tilting to the left causes movement of ball 28 and contact with housing 12 and spring 22 whereas movement to the right causes ball 28 to roll in contact with spring 58 and housing 12.

In FIG. 10, switch 62 is shown in use as a proximity switch wherein movement of magnets 72 as indicated selectively adjacent housing 12 causes ball 28 to be drawn upwardly into portions 64 or 66 of housing 12 and closing the switch from housing 12 to either of electrodes 24 or 60. It is contemplated that magnets 72 can just as well be electromagnets placed adjacent housing portions 64 and 66 and selectively energized for causing movement of ball 28 and selective contact with springs 22 and 58.

In FIG. 11, switch 62 is placed in the position wherein the housing first end 20 and second end 18 along with housing portions 64 and 66 extend generally vertically downwardly. In this position, a peak 74 is created between housing portions 64 and 66 and ball 28 is prevented from retaining an intermediate position as, for example, shown in the embodiment of FIG. 8. Here, peak 74 causes ball 28 to always roll due to gravitational forces downwardly toward either spring 22 or 58. Similar to other embodiments, this switch 62 can function as a tilt switch, a proximity switch, or a relay. In this embodiment, however, momentary tilting or a momentary application of magnetic flux can cause the actuation or change of ball position for making contact with either spring 22 or spring 58. Additionally, this switch would be considered a break before make type similar to that of FIG. 10.

For enhancing contact between the ball and spring and ball housing and thereby increasing the life of the switch, as shown in FIG. 15, housing 12 can be wetted with mercury 76. It is also contemplated that ball 28 as well as spring 22 and/or spring 58 can be wetted with mercury or other equivalent liquids or plated. Additionally, for preventing arcing, housing 12 can be filled With an arc quenching gas such as argon, hydrogen, etc., or a vacuum can be formed in housing 12. As also discussed hereinabove, housing 12 can be square or rectangular in cross section as shown in FIG. 14 thereby increasing the number of contact points between ball 28 and housing 12.

Enhancement of contact between ball 28 and springs 22 and 58 is accomplished by providing a spring that is also laterally flexible as shown by arrows 78 in FIG. 12. In this fashion, as ball 28 rolls toward the end 80 of spring 22, the spring will flex laterally with the weight or force of ball 28 and causing ball 28 to be "cupped" by spring end 80 as shown. This, therefore, provides a circular contact area generally designated by the numeral 82 whereat contact is made between ball 28 and spring 22. Further yet, this circular area can be increased by increasing the diameter of spring end 80 dependent on the overall outside diameter of ball 28.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electrical switch comprising:

an elongate electrically conductive housing having a first open end and a second closed end;

a flexible electrically-conductive spring extending longitudinally in said housing toward but short of said housing second end;

means at said housing first end for supporting said spring away from said housing and preventing electrical contact therebetween; and, a spherical electrically-conductive ball in said housing between said spring and said housing second end, said ball being selectively rolling in said housing and selectively coming in contact with said spring and said housing and creating an electrical path from said housing through said ball and to said spring.

2. The electrical switch of claim 1 wherein said supporting means is a plastic seal and a portion of said spring extends therethrough and out of said housing.

3. The electrical switch of claim 1 wherein said supporting means is a plastic seal and an electrode is electrically affixed to said spring and extends out of said housing.

4. The electrical switch of claim 1 wherein said switch is selectively actuated by placing said longitudinal housing at an angle with respect to the horizontal and selectively placing said ball in and out of contact with said spring and housing.

5. The electrical switch of claim 1 wherein said housing and spring are non-magnetic and said ball is magnetic and, further, comprising magnet means for selectively actuating and de-actuating said switch.

6. The electrical switch of claim 5 wherein said magnet means is a permanent magnet adapted for selective placement adjacent said housing.

7. The electrical switch of claim 5 wherein said magnet means is an electric magnet adjacent said housing and selectively energized for drawing said ball theretoward.

8. The electrical switch of claim 5 wherein said housing is supported with said second end vertically below said first end whereby said ball is gravitationally pulled toward said housing second end and away from said spring.

9. The electrical switch of claim 5 wherein said housing is supported with said second end vertically above said first end whereby said ball is gravitationally pulled toward said first end and in contact with said spring and housing.

10. The electrical switch of claim 5 wherein said non-magnetic housing and spring are made of a material selected from copper, brass, aluminum and non-magnetic stainless steel.

11. The electrical switch of claim 1 wherein said housing, ball and spring are wetted with mercury.

12. The electrical switch of claim 1 wherein said housing is cylindrically-shaped in cross section.

13. An electrical switch comprising:

an elongate electrically conductive housing having a first end and a second end;

a first flexible electrically-conductive spring extending longitudinally in said housing from said first end;

a second flexible electrically-conductive spring extending longitudinally in said housing from said housing second end;

means at each of said housing first and second ends for supporting said first and second springs away from said housing and preventing electrical contact between said springs and said housing; and, a spherical electrically-conductive ball in said housing between said first and second springs, said ball being selectively rolling in said housing and selectively coming in contact with either of said first spring and said housing or said second spring and said housing and creating an electrical path from said housing through said ball and to either of said first or second springs.

14. The electrical switch of claim 13 wherein said supporting means at said first and second ends of said housing are plastic seals and a portion of said springs extend therethrough and out of said housing.

15. The electrical switch of claim 13 wherein said supporting means at each of said first and second ends of said housing is a plastic seal and electrodes are electrically affixed to each of said springs and extend out of said housing.

16. The electrical switch of claim 13 wherein said housing is cylindrically-shaped in cross section.

17. The electrical switch of claim 13 wherein said switch is selectively actuated by placing said longitudinal housing at an angle with respect to the horizontal and selectively placing said ball in and out of contact with said first spring and said housing or said second spring and said housing.

18. The electrical switch of claim 13 wherein said housing and spring are non-magnetic and said ball is magnetic and, further, comprising magnet means for selectively moving said ball within said housing.

19. The electrical switch of claim 18 wherein said magnet means is a permanent magnet adapted for selective placement adjacent said housing.

20. The electrical switch of claim 18 wherein said magnet means is an electric magnet adjacent said housing and selectively energized for drawing said ball theretoward.

21. The electrical switch of claim 13 wherein a housing first portion extending around said first spring is at an angle with respect to a housing second portion extending around said second spring and when said first and second housing portions extend generally vertically upwardly a depression is formed therebetween creating an intermediate position whereat said ball is gravitationally drawn away from both of said first and second springs and when said housing first and second portions extend generally vertically downwardly, a peak is formed whereat said ball is prevented from resting between said first and second springs, said ball being gravitationally pulled toward either one of said first or second springs.

22. The electrical switch of claim 21 wherein said housing is non-magnetic and said ball is magnetic and further comprising magnet means for selectively moving said ball in said housing.

23. The electrical switch of claim 22 wherein said magnet means is a permanent magnet adapted for selective placement adjacent said housing.

24. The electrical switch of claim 22 wherein said magnet means is an electric magnet adjacent said housing selectively energized for drawing said ball theretoward.

25. The electrical switch of claim 1 wherein said supporting means is a glass to metal seal and a portion of said spring extends therethrough and out of said housing.

26. The electrical switch of claim 1 wherein said supporting means is a glass to metal seal and an electrode is electrically affixed to said spring and extends out of said housing.

* * * * *